US007354410B2

(12) United States Patent
Perry et al.

(10) Patent No.: US 7,354,410 B2
(45) Date of Patent: Apr. 8, 2008

(54) COMPRESSION TREATMENT SYSTEM

(75) Inventors: Matthew J. Perry, East Greenwich, RI (US); Mark A. Vess, Hanson, MA (US); Scott Wudyka, Leominster, MA (US)

(73) Assignee: Tyco Healthcare Group LP, Mansfield, MA (US)

( * ) Notice: Subject to any disclaimer, the term of this patent is extended or adjusted under 35 U.S.C. 154(b) by 312 days.

(21) Appl. No.: 10/784,323

(22) Filed: Feb. 23, 2004

(65) Prior Publication Data

US 2005/0187500 A1 Aug. 25, 2005

(51) Int. Cl.
*A61H 7/00* (2006.01)

(52) U.S. Cl. ..... 601/151; 602/13; 128/DIG. 20

(58) Field of Classification Search ..... 606/201–204; 601/148–151; 602/13; 128/DIG. 20
See application file for complete search history.

(56) References Cited

U.S. PATENT DOCUMENTS

| | | | | |
|---|---|---|---|---|
| 1,608,239 | A | 11/1926 | Rosett | |
| 3,307,533 | A | 3/1967 | Meredith et al. | 128/24 |
| 3,728,875 | A | 4/1973 | Hartigan et al. | 66/172 E |
| 3,811,431 | A | 5/1974 | Apstein | 128/64 |
| 3,892,229 | A | 7/1975 | Taylor et al. | 128/24 R |
| 3,924,613 | A | 12/1975 | Beck | 128/24 R |
| 4,013,069 | A | 3/1977 | Hasty | 128/24 R |
| 4,030,488 | A | 6/1977 | Hasty | 128/24 R |
| 4,077,402 | A | 3/1978 | Benjamin, Jr. et al. | 128/24 R |
| 4,091,804 | A | 5/1978 | Hasty | 128/24 R |
| 4,156,425 | A | 5/1979 | Arkans | 128/24 R |
| 4,198,961 | A | 4/1980 | Arkans | 128/24 R |
| 4,207,875 | A | 6/1980 | Arkans | 128/24 R |
| 4,207,876 | A | 6/1980 | Annis | 128/24 R |
| 4,253,449 | A | 3/1981 | Arkans et al. | 128/24 R |
| 4,355,632 | A | 10/1982 | Sandman | 128/24 R |
| 4,396,010 | A * | 8/1983 | Arkans | 601/152 |
| 4,408,599 | A | 10/1983 | Mummert | 128/24 R |
| 4,419,988 | A | 12/1983 | Mummert | 128/24 R |
| 4,469,099 | A | 9/1984 | McEwen | 128/327 |
| 4,481,937 | A | 11/1984 | Arkans | 128/24 R |
| 4,624,244 | A | 11/1986 | Taheri | 128/24 R |
| 4,624,248 | A | 11/1986 | Poole et al. | 128/89 R |

(Continued)

FOREIGN PATENT DOCUMENTS

DE 19846922 A1 4/2000

(Continued)

OTHER PUBLICATIONS

Tyco Healthcare Kendall, SCD Response Catalog, Mar. 2000, pp. 1-2.

(Continued)

*Primary Examiner*—Michael A. Brown
(74) *Attorney, Agent, or Firm*—Edward S. Jarmolowicz

(57) ABSTRACT

A compression treatment system is provided that includes a first bladder supported about a limb. A second bladder is supported about the limb. The bladders are in fluid communication with a fluid source and the bladders are inflated such that the first bladder is inflated for a first time period and the second bladder is inflated for a second time period. The second time period is initiated within the first time period. A single pressure sensor communicates with the first bladder and the second bladder.

23 Claims, 5 Drawing Sheets

U.S. PATENT DOCUMENTS

| | | | | |
|---|---|---|---|---|
| 4,696,289 | A | 9/1987 | Gardner et al. | 128/64 |
| 4,762,121 | A | 8/1988 | Shienfeld | 128/64 |
| 4,865,020 | A | 9/1989 | Bullard | 128/64 |
| 5,007,411 | A | 4/1991 | Dye | 128/64 |
| 5,022,387 | A | 6/1991 | Hasty | 128/64 |
| 5,027,797 | A | 7/1991 | Bullard | 128/64 |
| 5,031,604 | A | 7/1991 | Dye | 128/64 |
| 5,052,377 | A | 10/1991 | Frajdenrajch | 128/64 |
| 5,109,832 | A | 5/1992 | Proctor et al. | 128/24 R |
| 5,186,163 | A | 2/1993 | Dye | 128/64 |
| 5,254,087 | A | 10/1993 | McEwen | 604/66 |
| 5,307,791 | A | 5/1994 | Senoue et al. | 601/9 |
| 5,354,260 | A | 10/1994 | Cook | 602/13 |
| 5,383,894 | A | 1/1995 | Dye | 606/201 |
| 5,437,610 | A | 8/1995 | Cariapa et al. | 601/152 |
| 5,478,119 | A | 12/1995 | Dye | 285/26 |
| 5,502,377 | A | 3/1996 | Freund | 324/175 |
| 5,524,087 | A | 6/1996 | Kawamura et al. | 364/721 |
| 5,556,415 | A | 9/1996 | McEwen et al. | 606/202 |
| 5,575,762 | A | 11/1996 | Peeler et al. | 601/152 |
| 5,588,955 | A | 12/1996 | Johnson, Jr. et al. | 601/152 |
| 5,591,200 | A * | 1/1997 | Cone et al. | 606/201 |
| 5,626,556 | A | 5/1997 | Tobler et al. | 601/151 |
| D384,159 | S | 9/1997 | Tsai | D24/215 |
| 5,681,339 | A | 10/1997 | McEwen et al. | 606/202 |
| 5,711,760 | A | 1/1998 | Ibrahim et al. | 601/149 |
| 5,769,797 | A | 6/1998 | Van Brunt et al. | 601/41 |
| 5,792,109 | A * | 8/1998 | Ladd | 604/151 |
| 5,795,312 | A | 8/1998 | Dye | 601/151 |
| 5,830,164 | A | 11/1998 | Cone et al. | 601/152 |
| 5,843,007 | A | 12/1998 | McEwen et al. | 601/152 |
| 5,855,589 | A | 1/1999 | McEwen et al. | 606/202 |
| 5,876,359 | A | 3/1999 | Bock et al. | 601/150 |
| 5,911,735 | A | 6/1999 | McEwen et al. | 606/201 |
| 5,931,853 | A | 8/1999 | McEwen et al. | 606/203 |
| 5,935,146 | A | 8/1999 | McEwen et al. | 606/202 |
| 5,951,502 | A | 9/1999 | Peeler et al. | 601/149 |
| 5,968,073 | A * | 10/1999 | Jacobs | 606/202 |
| 5,989,204 | A | 11/1999 | Lina | 601/152 |
| 5,997,495 | A | 12/1999 | Cook et al. | 602/62 |
| 6,001,119 | A | 12/1999 | Hampson et al. | 606/202 |
| 6,007,559 | A | 12/1999 | Arkans | 606/201 |
| 6,036,662 | A | 3/2000 | Van Brunt et al. | 601/41 |
| 6,051,016 | A | 4/2000 | Mesaros et al. | 606/202 |
| 6,062,244 | A | 5/2000 | Arkans | 137/1 |
| 6,231,532 | B1 | 5/2001 | Watson et al. | 601/150 |
| 6,290,662 | B1 | 9/2001 | Morris et al. | 601/149 |
| 6,296,617 | B1 | 10/2001 | Peeler et al. | 601/152 |
| 6,315,745 | B1 | 11/2001 | Kloecker | 602/13 |
| D452,570 | S | 12/2001 | Since | D24/200 |
| 6,436,064 | B1 | 8/2002 | Kloecker | 602/13 |
| 6,440,093 | B1 | 8/2002 | McEwen et al. | 601/150 |
| 6,450,981 | B1 | 9/2002 | Shabty et al. | 601/150 |
| 6,468,237 | B1 | 10/2002 | Lina | 601/150 |
| 6,475,228 | B1 | 11/2002 | Mesaros et al. | 606/202 |
| 6,494,852 | B1 | 12/2002 | Barak et al. | 601/151 |
| D473,314 | S | 4/2003 | Since | D24/200 |
| 6,544,202 | B2 | 4/2003 | McEwen et al. | 601/150 |
| 6,572,621 | B1 | 6/2003 | Zheng et al. | 606/64 |
| 6,589,267 | B1 | 7/2003 | Hui | 606/202 |
| 6,592,534 | B1 | 7/2003 | Rutt et al. | 601/151 |
| 6,629,941 | B1 | 10/2003 | Ishibashi et al. | 601/152 |
| 6,786,879 | B1 | 9/2004 | Bolam et al. | 601/152 |
| 2002/0042583 | A1 | 4/2002 | Barak et al. | 601/1 |
| 2002/0042584 | A1 | 4/2002 | Rue | 602/5 |
| 2006/0161081 | A1 * | 7/2006 | Barak et al. | 601/151 |

FOREIGN PATENT DOCUMENTS

| | | | |
|---|---|---|---|
| EP | 0552515 | A1 | 7/1993 |
| EP | 0861651 | A1 | 9/1998 |
| EP | 1018329 | A2 | 7/2000 |
| GB | 2313784 | A | 12/1997 |
| WO | WO 99/63892 | | 12/1999 |
| WO | 0197747 | A1 | 12/2001 |
| WO | WO 2004/011842 | A1 | 2/2004 |

OTHER PUBLICATIONS

Tyco Healthcare Kendall, SCD Soft Sleeve Catalog, Apr. 2001, pp. 1-2.

The Kendall Company, Vascular Therapy Products Catalog, Jan. 1996, pp. 8-5-8-7.

The Kendall Company, The New SCD Compression Sleeve, Aug. 1993, pp. 1-2.

Tyco Healthcare Kendall, Prevention Gets Personal, Mar. 2001, pp. 1, 2, 4.

Kendall SCD, Sequential Compression Sleeves, Patent Information, Jan. 1993, 6 pgs.

PCT International Search Report, May 25, 2005, 4 pgs.

PCT International Search Report, Jun. 2, 2005, 5 pgs.

PCT International Search Report, Jun. 2, 2005, 7 pgs.

PCT Invitation to Pay Additional Fees, Jun. 10, 2005, 6 pgs.

Flow Power Graphic Symbols, Pneumatic Division, Richland MI 49083, published in the United States, one (1) page. Parker Motion and Control.

* cited by examiner

COMPRESSION TREATMENT SYSTEM

BACKGROUND

1. Technical Field

The present disclosure generally relates to the field of vascular therapy for application to a limb of a body, and more particularly, to a compression treatment system having a controller that regulates fluid flow.

2. Description of the Related Art

A major concern for immobile patients and persons alike are medical conditions that form clots in the blood, such as, deep vein thrombosis (DVT) and peripheral edema. Such patients and persons include those undergoing surgery, anesthesia, extended periods of bed rest, etc. These blood clotting conditions generally occur in the deep veins of the lower extremities and/or pelvis. These veins, such as the iliac, femoral, popiteal and tibial return deoxygenated blood to the heart. For example, when blood circulation in these veins is retarded due to illness, injury or inactivity, there is a tendency for blood to accumulate or pool. A static pool of blood is ideal for clot formations. A major risk associated with this condition is interference with cardiovascular circulation. Most seriously, a fragment of the blood clot can break loose and migrate. A pulmonary emboli can form blocking a main pulmonary artery, which may be life threatening.

The conditions and resulting risks associated with patient immobility may be controlled or alleviated by applying intermittent pressure to a patient's limb, such as, for example, a leg including the thigh, calf and foot to assist in blood circulation. Known devices have been employed to assist in blood circulation, such as, one piece pads and compression boots. See, for example, U.S. Pat. Nos. 6,290,662 and 6,494,852.

For example, sequential compression devices have been used, which consist of an air pump connected to a disposable wraparound pad by a series of air tubes. The wraparound pad is configured for placement about a portion of a patient's leg, such as the thigh, calf or foot. Multiple pads may be mounted to the leg to cover the various portions of the leg. Air is then forced into different parts of the wraparound pad(s) in sequence, creating pressure around the thigh, calf or foot, thereby improving venous return.

These known devices may suffer from various drawbacks due to their bulk and cumbersome nature of use. These drawbacks reduce comfort, compliance and may disadvantageously prevent mobility of the patient as recovery progresses after surgery.

Further, such known sequential compression devices typically include a controller assembly that regulates air flow and pressure in the wraparound pad(s). The controller assembly can be mounted to a bed and plugged into a wall outlet for power during use. This arrangement, however, can present challenges for example, when the patient needs to perform certain tasks, e.g., bathroom, physical therapy, etc. In these situations, the pads are usually removed, thus disadvantageously discontinuing vascular therapy. Thus, these controller assemblies suffer from various drawbacks because they do not accommodate patient transport or mobility and are not typically adaptable for inflation of thigh, calf and foot pads.

Therefore, it would be desirable to overcome the disadvantages and drawbacks of the prior art with a compression treatment system having a controller that is adaptable for inflating thigh, calf and foot sleeves and accommodates patient transport and mobility to provide continuous vascular therapy. It would be desirable if the system automatically detects the types of sleeves connected thereto. It would be highly desirable if the system included a pneumatic circuit that facilitates pressure monitoring with a single pressure transducer to achieve the advantages of the present disclosure. It is contemplated that the compression treatment system is easily and efficiently manufactured.

SUMMARY

Accordingly, a compression treatment system is provided having a controller that is adaptable for inflating thigh, calf and foot sleeves and accommodates patient transport and mobility to provide continuous vascular therapy for overcoming the disadvantages and drawbacks of the prior art. Desirably, the system automatically detects the types of sleeves connected thereto. Most desirably, the system includes a pneumatic circuit that facilitates pressure monitoring with a single pressure transducer to achieve the advantages of the present disclosure. The compression treatment system is easily and efficiently fabricated.

The compression treatment system, in accordance with the principles of the present disclosure, can provide intermittent pneumatic compression for the prevention of DVT. The compression treatment system may also include venous refill detection, as will be discussed, and is compact, quiet, lightweight, and offers battery power. The compression treatment system also has the ability to provide sequential, gradient compression to each limb individually and the flexibility to provide compression to various sleeves, which may, for example, include three bladders. The sleeves may include thigh length tear-away features and knee length sleeves, as will be discussed. In addition, the compression treatment system can provide higher pressure, slow compression to a foot sleeve. The compression treatment system provides uninterrupted DVT prophylaxis as the system is used throughout a treatment facility, and can be worn and used continuously by the patient during the entire period of risk.

The compression treatment system may be portable to provide continuous therapy for the patient at risk for DVT. This configuration advantageously facilitates continuous vascular therapy during patient activity and tasks such as, for example, transport for testing, bathroom, physical therapy, etc. Thus, the compression treatment system prevents interruptions in therapy by providing a controller that will run on a battery when it is not plugged in, and will also be comfortable, compact, and light enough to move with the patient as needed.

The compression treatment system includes a controller, tubing sets, and sleeves. For example, the compression treatment system delivers air through the tubing sets to a pair of disposable sleeves, one for each limb. The sleeves can have three bladders each, which correspond to the ankle, calf and thigh. The compression treatment system independently compresses one of the limbs, left or right. Inflation is alternated between the two limbs when both are connected. Alternatively, only one sleeve can be connected.

Alternatively, the compression treatment system is used as a slow compression foot device. In this configuration, the compression treatment system includes a pair of single-patient-use, single-bladder disposable foot garments alternative to the sleeves. A single foot garment may also be used. The compression treatment system also provides for employment of a foot garment on a first limb and a sleeve on a second limb.

The compression treatment system includes tubing set connector ports that interlock with the mating geometry on the tubing sets. When the compression treatment system is initially powered, air is delivered through the ports until the system recognizes which ports are connected to a sleeve and what types of sleeves, i.e., leg sleeve or foot garment, are connected to those ports. Compression therapy is delivered to the ports with the appropriate sleeves connected.

For example, the compression treatment system provides clinical parameters for vascular therapy such as an 11-second inflation cycle, followed by a vent period of 20 to 60 seconds, depending on the venous refill measurement. The 11-second compression time is sequential: at 0 seconds a first bladder starts inflating. At 2.67 seconds a second bladder starts inflating, and at 5.67 seconds a third bladder starts inflating. After 11 seconds, all three bladders vent. The pressures during the inflation period must remain gradient with the first bladder being greater than the second bladder, and the second bladder being greater than the third bladder. By way of example, the end of cycle pressures may be 45 mm Hg in the first bladder, 40 mm Hg in the second bladder, and 30 mm Hg in the third bladder. Compression continues in this cyclical pattern until either the compression treatment system is turned off or the controller alarms.

By way of another non-limiting example, the foot compression parameters may include a 5-second inflation cycle followed by the same vent period timing as provided above for the sleeve compression (20-60 seconds). The end of cycle pressure for the foot sleeve will have a set pressure target of 130 mm Hg by the end of the 5-second inflation period.

Venous refill detection may be employed with the compression treatment system. Venous refill detection includes trapping a small amount of air in the second bladder described and monitoring the pressure increase as the veins in the limb of a patient refill with blood. As the compression treatment system reaches set pressure, and every 30 minutes thereafter, the controller measures venous refill and adjusts the vent time between inflation cycles for any individual limb from 20 to 60 seconds. The longer of the venous refill measurements from both limbs will be used to adjust the vent time.

The compression treatment system benefits from several advantages including a battery powered controller that is compact and lightweight for portability. The compression treatment system may also be used with one or two limbs and can provide slow compression to a foot garment. The compression treatment system can also detect the type of sleeve connected and automatically apply the appropriate compression.

The compression treatment system also includes a pneumatic circuit designed for use with the compression treatment system to allow for bladder inflation and pressure monitoring using only one transducer. Pressure monitoring from the manifold-side of the solenoid valves accounts for the pressure drop across the valves with the added advantage of only requiring one transducer to monitor any connected bladder. This configuration advantageously results in a lower manufacturing cost and reduced maintenance requirements, particularly with regard to transducer calibration.

In one embodiment, in accordance with the principles of the present disclosure, the compression treatment system includes a first bladder that is supported about a limb. A second bladder is also supported about the limb. The bladders are in fluid communication with a fluid source and the bladders are inflated such that the first bladder is inflated for a first time period and the second bladder is inflated for a second time period. The second time period is initiated within the first time period. A single pressure sensor communicates with the first bladder and the second bladder. The pressure transducer is configured to monitor pressure of each of the bladders.

The compression treatment system may include a controller that communicates with the pressurized fluid source and the pressure transducer. The controller is configured to monitor and regulate pressure in the bladders. The controller may be disposed with a housing that is portable. The housing may include a plurality of ports connectable to a plurality of bladders.

The pressure transducer can monitor pressure at each of the plurality of ports to determine if a bladder is connected thereto and sends a representative signal to the controller. The controller may include separate valves that regulate inflation of the bladders. The compression treatment system may define a pneumatic circuit. The pressure transducer may be coupled to the pneumatic circuit and disposed between the pressurized fluid source and the valves in the pneumatic circuit.

The compression treatment system may include a third bladder supported about a foot. The third bladder is in fluid communication with the fluid source and the single pressure sensor communicates with bladders. The pressurized fluid source can alternately inflate the bladders disposed about the limb and the bladder disposed about the foot.

In an alternate embodiment, the compression treatment system includes a first plurality of bladders that are supported about a first limb. A second plurality of bladders are supported about a second limb, the bladders are in fluid communication with a fluid source. A first bladder of the first plurality of bladders is inflated for a first time period and a second bladder of the first plurality of bladders is inflated for a second time period. The second time period is initiated within the first time period.

A first bladder of the second plurality of bladders is inflated for a third time period and a second bladder of the second plurality of bladders is inflated for a fourth time period. The fourth time period is initiated within the third time period. A single pressure sensor communicates with the bladders. The pressurized fluid source may alternately inflate the bladders disposed about the first limb and the bladders disposed about the second limb.

In another alternate embodiment, the compression treatment system includes a first plurality of bladders being supported about a first limb and a second plurality of bladders being supported about a second limb. Each bladder of the first plurality of bladders and the second plurality of bladders having a separate valve in communication therewith. The valves are in fluid communication with a fluid source.

A first valve is open such that a first bladder of the first plurality of bladders is inflated for a first time period and a second valve is open such that a second bladder of the first plurality of bladders is inflated for a second time period. The second time period is initiated within the first time period. A third valve is open such that a third bladder of the first plurality is inflated for a third time period. The third time period is initiated within the second time period.

A fourth valve is open such that a first bladder of the second plurality of bladders is inflated for a fourth time period and a fifth valve is open such that a second bladder of the second plurality of bladders is inflated for a fifth time period. The fifth time period is initiated within the fourth time period. A sixth valve is open such that a sixth bladder of the second plurality is inflated for a sixth time period. The sixth time period is initiated within the fifth time period. A single pressure sensor communicates with the bladders.

BRIEF DESCRIPTION OF THE DRAWINGS

The objects and features of the present disclosure, which are believed to be novel, are set forth with particularity in the appended claims. The present disclosure, both as to its organization and manner of operation, together with further objectives and advantages, may be best understood by reference to the following description, taken in connection with the accompanying drawings, which are described below.

DETAILED DESCRIPTION OF EXEMPLARY EMBODIMENTS

Figure 1:
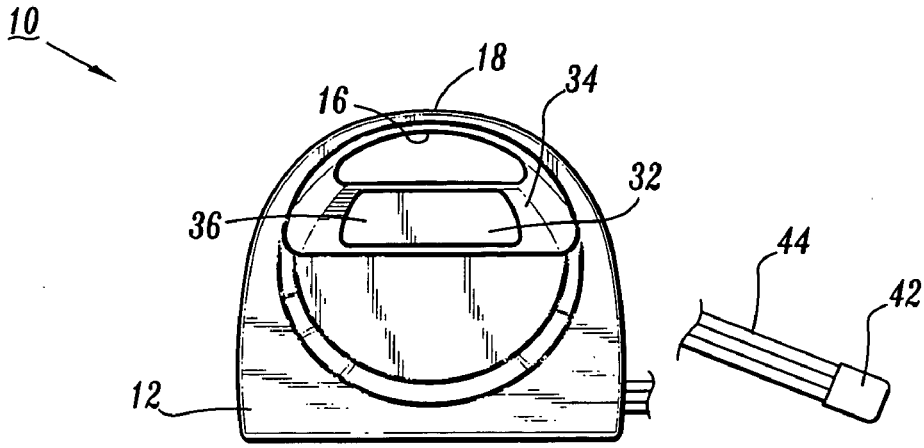
FIG. 1 is a front view of one particular embodiment of a compression treatment system in accordance with the principles of the present disclosure.

The exemplary embodiments of the compression treatment system and methods of operation disclosed are discussed in terms of vascular therapy including a prophylaxis compression apparatus for application to a limb of a body and more particularly in terms of a compression treatment system having a controller that is adaptable for inflating thigh, calf, ankle and foot sleeves and accommodates patient transport and mobility. It is contemplated that the compression treatment system may be employed for preventing and overcoming the risks associated with patient immobility. It is further contemplated that the compression treatment system alleviates the conditions arising from patient immobility to prevent for example, DVT, peripheral edema, etc. It is contemplated that the compression treatment system according to the present disclosure may be attributable to all types of venous compression systems, including, but not limited to a prophylaxis sequential compression apparatus. The term "prophylaxis sequential" shall not be construed as limiting the general venous compression treatment system described herein. It is envisioned that the present disclosure, however, finds application with a wide variety of immobile conditions of persons and patients alike, such as, for example, those undergoing surgery, anesthesia, extended periods of bed rest, obesity, advanced age, malignancy, prior thromboembolism, etc.

In the discussion that follows, the term "proximal" refers to a portion of a structure that is closer to a torso of a subject and the term "distal" refers to a portion that is further from the torso. As used herein the term "subject" refers to a patient undergoing vascular therapy using the compression treatment system. According to the present disclosure, the term "practitioner" refers to an individual administering the compression treatment system and may include support personnel.

The following discussion includes a description of the compression treatment system, followed by a description of an exemplary method of operating the compression treatment system in accordance with the principles of the present disclosure. Reference will now be made in detail to the exemplary embodiments and disclosure, which are illustrated with the accompanying figures.

Turning now to the figures, wherein like components are designated by like reference numerals throughout the several views. Referring initially to FIGS. 1-5, there is illustrated a compression treatment system 10, constructed in accordance with the principles of the present disclosure. Compression treatment system 10 includes a housing 12. Housing 12 encloses the components of a controller 14 (shown schematically in FIG. 5) disposed therein.

Housing 12 has a semi-circular configuration and has a handle cutout 16 along its apex 18 to facilitate transport and subject mobility. It is envisioned that housing 12 may be variously configured and dimensioned such as, for example, rectangular, spherical, etc. It is further envisioned that housing 12 may be assembled by any appropriate process such as, for example, snap fit, adhesive, solvent weld, thermal weld, ultrasonic weld, screw, rivet, etc. Alternatively, housing 12 may be monolithically formed or integrally assembled of multiple housing sections and may be substantially transparent, opaque, etc. Housing 12 may include ribs, ridges, etc. to facilitate manipulation of compression treatment system 10.

The components of housing 12 can be fabricated from a material suitable for medical applications, such as, for example, polymerics or metals, such as stainless steel, depending on the particular medical application and/or preference of a clinician. Semi-rigid and rigid polymerics are contemplated for fabrication, as well as resilient materials, such as molded medical grade polypropylene. However, one skilled in the art will realize that other materials and fabrication methods suitable for assembly and manufacture, in accordance with the present disclosure, also would be appropriate.

Figure 2:
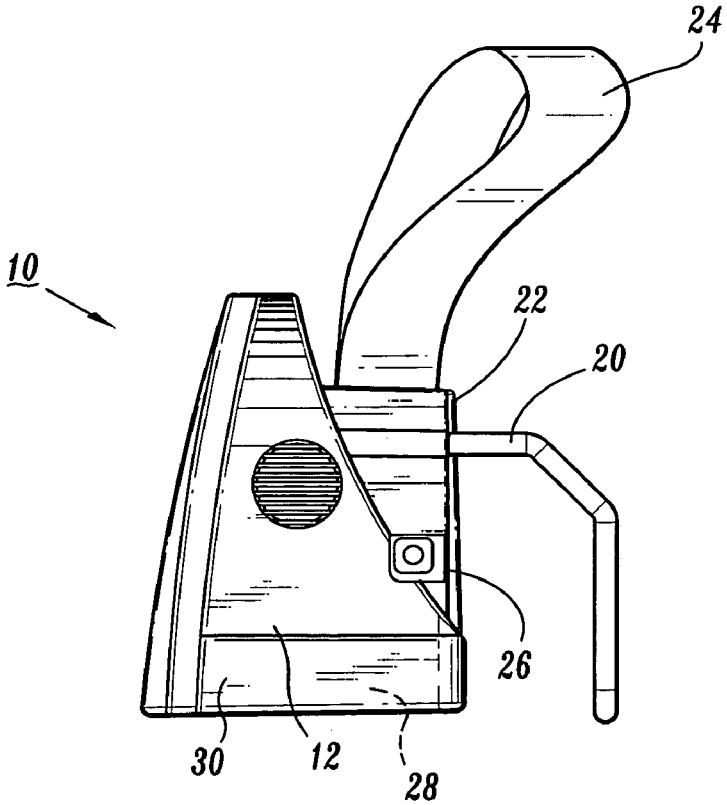
FIG. 2 is a side view of the compression treatment system shown in FIG. 1.
Figure 3:
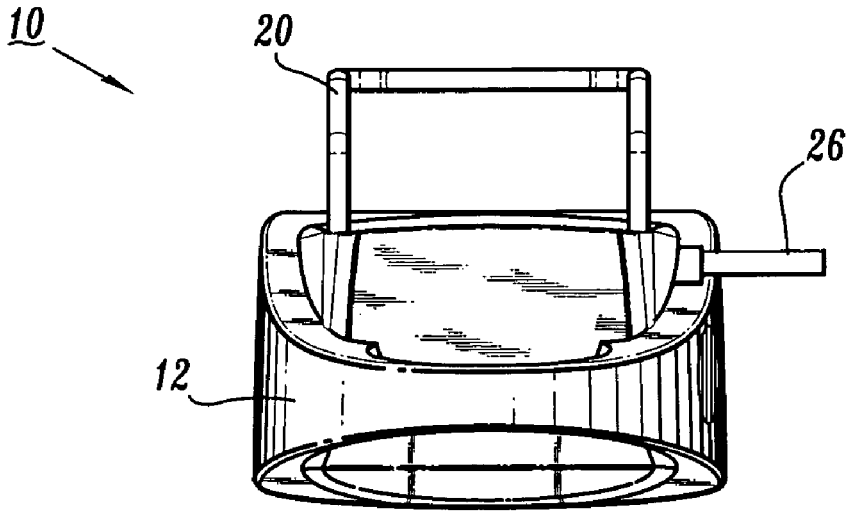
FIG. 3 is a top view of the compression treatment system shown in FIG. 1.

Housing 12 is portable to facilitate continuous vascular therapy to a subject (not shown). Housing 12 includes a bracket 20 that facilitates releasable mounting of housing 12 with for example, a hospital bed, table, etc. Bracket 20 extends from a rear portion 22 of housing 12 and provides a hook configuration for suspending housing 12 from a subject's bed, etc. It is contemplated that bracket 20 may be suspended from various structure for releasable mounting of housing 12, or alternatively, that housing 12 does not include a bracket and may be placed on a floor or other supporting surface. Alternatively, housing 12 includes a shoulder strap 24, as shown in FIG. 2, that allows housing 12 to be worn on the subject or practitioner during transport. Shoulder strap 24 may be employed with or without bracket 20 and may, for example, be secured to any portion of the housing 12 including handle 16.

Compression treatment system 10 employs an electrical AC/DC switching power supply for operation of its components. A power cord 26 is connected to housing 12 for conducting power to the components of controller 14. Power cord 26 accesses an AC power supply via a wall outlet, etc. Controller 14 may include a transformer or other electronics for connecting to the power supply. It is envisioned that power cord 26 may be wrapped around bracket 20 for storage and during transport and subject mobility. It is further envisioned that compression treatment system 10 may include a storage capture mechanism that retains power cord 26 with housing 12. The storage capture mechanism may include an elastic cord, pulley, etc.

Compression treatment system 10 also employs a battery 28 for powering the components of controller 14 to facilitate transport and subject mobility. Battery 28 is disposed within a battery compartment 30 of housing 12. It is contemplated that battery 28 may include one or a plurality of cells. The battery cells may be lithium-ion type, etc. It is further contemplated that battery 28 is rechargeable and may be employed for various ranges of operation time, such as, for example, 6 hours, 8 hours, 10 hours, etc. For example, power cord 26 may be unplugged and captured by the storage capture mechanism of housing 12. Compression treatment system 10 then runs on battery 28 power and the subject is ambulatory.

It is envisioned that battery 28 may be mounted to an exterior surface of housing 12 or separate therefrom. It is further envisioned that compression treatment system 10 may include alternate sources of power supply, such as, for example, solar, non-electrical, etc., or alternatively may not include battery power.

Housing 12 has a control panel 32 disposed on a front surface 34 thereof. Control panel 32 includes controls and indicators for operation of compression treatment system 10. Control panel 32 has an LED display 36 that provides status indicia, messages, etc. of the various components of system 10, such as, for example, power, battery, sleeve identification and connection, inflation, venting, venous refill, errors, etc. Control panel 32 also includes manually activated switches for powering system 10, etc. It is contemplated that such switches are membrane type actuated by finger pressure, etc.

Figure 4:
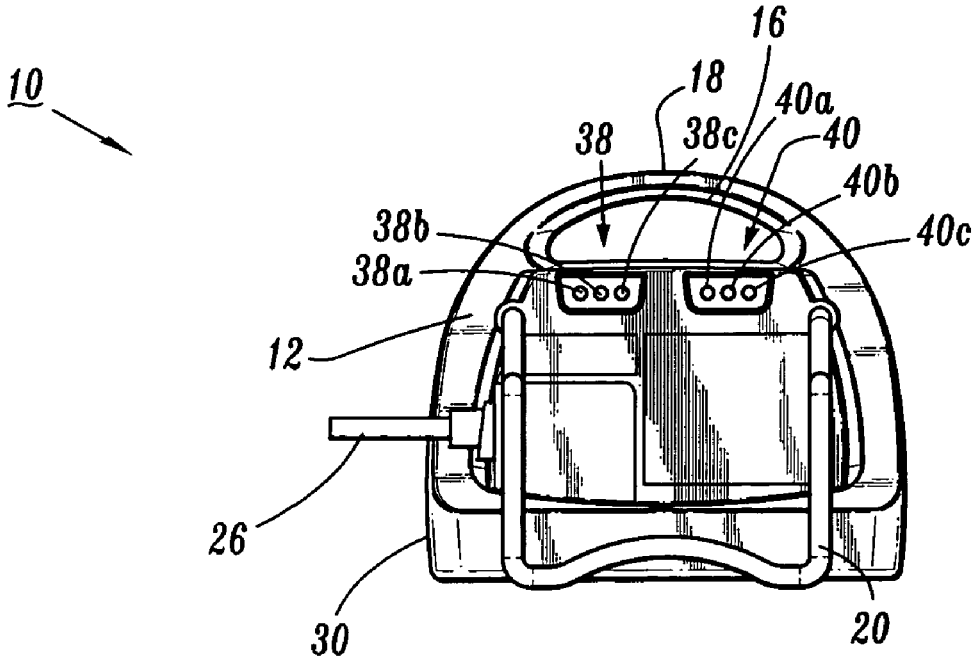
FIG. 4 is a rear view of the compression treatment system shown in FIG. 1.

Rear portion 22 of housing 12 defines ports 38, 40 (FIG. 4). Ports 38, 40 include output ports 38*a*, 38*b*, 38*c*, and output ports 40*a*, 40*b*, 40*c*, respectively. Output ports 38*a*, 38*b*, 38*c*, and output ports 40*a*, 40*b*, 40*c* are in fluid communication with inflatable chambers 46*a*, 46*b*, 46*c* of a compression sleeve 46 and inflatable chambers 48*a*, 48*b*, 48*c* of a compression sleeve 48, respectively, which are configured to fit around the legs of a subject, via a mating connector 42 and tubing set 44, as will be discussed. Output ports 38*a*, 38*b*, 38*c*, 40*a*, 40*b*, 40*c* are configured for connection to tubing set 44. Each of ports 38, 40 are connectable to a particular compression sleeve, for example, leg sleeve, foot sleeve, etc.

Figure 5:
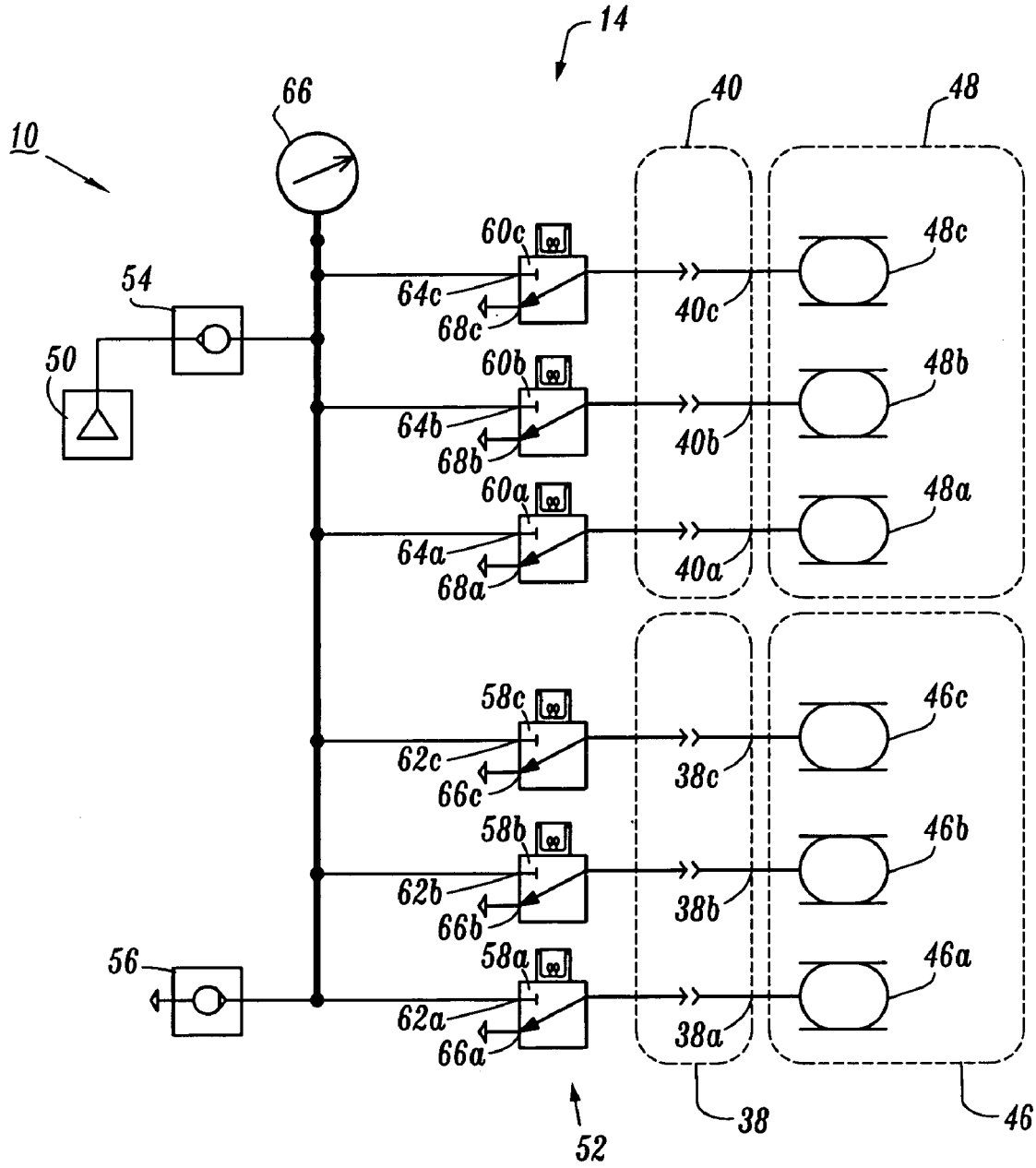
FIG. 5 is a schematic representation of a pneumatic circuit of the compression treatment system shown in FIG. 1.

Ports 38, 40 are also connected with the components of controller 14 disposed within housing 12 to facilitate inflation of selected compression sleeves, as illustrated in the pneumatic circuit shown in FIG. 5. Controller 14 includes a pressurized fluid source, such as, for example, a pump 50 that fluidly communicates with a valve manifold 52 for connection with ports 38, 40, as will be discussed. Pump 50 includes a motor that compresses air to valve manifold 52 via tubing or the like. The speed of the pump motor is electronically controlled to provide a corresponding compressor speed for respective output pressures as desired. It is contemplated that a power supply board, including the necessary electronics, circuitry, software, etc. known to one skilled in the art, is connected to the pump motor and other components of controller 14 to regulate power thereto. It is envisioned that pump 50 may be a diaphragm pump.

Controller 14 also includes a check valve 54 that prevents air leakage back through pump 50 when monitoring bladder pressure during venous refill detection, as will be discussed. A pressure relief valve 56 is disposed with the pneumatic circuit to protect against over pressure in the compression sleeves. Pressure relief valve 56 is configured to bleed excess air pressure if necessary. It is contemplated that various types of valves may be employed such as, for example, spring loaded plunger valves, etc.

Valve manifold 52 includes solenoid valves 58*a*, 58*b*, 58*c*, 60*a*, 60*b*, 60*c* that are coupled to output ports 38*a*, 38*b*, 38*c*, 40*a*, 40*b*, 40*c*, respectively. Solenoid valves 58*a*, 58*b*, 58*c*, 60*a*, 60*b*, 60*c* each have an associated solenoid that is electrically driven via a control processor of controller 14. The solenoid is coupled to a valve seat of each particular solenoid valve 58*a*, 58*b*, 58*c*, 60*a*, 60*b*, 60*c* such that the seat is operative to open and close the respective solenoid valve upon actuation of the solenoid. See, for example, the solenoid valves described in U.S. Pat. No. 5,876,359 to Bock et al., the entire contents of which is hereby incorporated by reference herein. It is contemplated that the control processor of controller 14 includes the necessary electronics, circuitry, software, etc. known to one skilled in the art to actuate solenoid valves 58*a*, 58*b*, 58*c*, 60*a*, 60*b*, 60*c* in response to varying conditions of compression treatment system 10 and other indications and measurements sensed by the components of controller 14. It is envisioned that one or a plurality of solenoid valves may be employed, or alternatively, that other types of valves may be used.

Solenoid valves 58*a*, 58*b*, 58*c*, 60*a*, 60*b*, 60*c* and their associated valve components are mounted to ports 38, 40 on the interior of housing 12. Solenoid valves 58*a*, 58*b*, 58*c*, 60*a*, 60*b*, 60*c* are two position, three-way normally closed valves, which have openings 62*a*, 62*b*, 62*c*, 64*a*, 64*b*, 64*c*, respectively. In the open position, air flows through openings 62*a*, 62*b*, 62*c*, 64*a*, 64*b*, 64*c* to the associated output port 38*a*, 38*b*, 38*c*, 40*a*, 40*b*, 40*c* and into inflatable chambers 46*a*, 46*b*, 46*c* of compression sleeve 46 and inflatable chambers 48*a*, 48*b*, 48*c* of compression sleeve 48. In the closed position, openings 62*a*, 62*b*, 62*c*, 64*a*, 64*b*, 64*c* are blocked and air from compression sleeves 46, 48 flows back through output port 38*a*, 38*b*, 38*c*, 40*a*, 40*b*, 40*c* and through vent ports 66*a*, 66*b*, 66*c*, 68*a*, 68*b*, 68*c* of the associated valve to deflate inflatable chambers 46*a*, 46*b*, 46*c*, 48*a*, 48*b*, 48*c*.

Solenoid valves 58*a*, 58*b*, 58*c*, 60*a*, 60*b*, 60*c* are operated in sequence to pressurize inflatable chambers 46*a*, 46*b*, 46*c*, 48*a*, 48*b*, 48*c* and provide sequential pressurization thereof and venting of the chambers under the control processor of controller 14. It is contemplated that solenoid valves 58*a*, 58*b*, 58*c*, 60*a*, 60*b*, 60*c* may be selectively actuated when cooling operation of the sleeves is desired, see for example, U.S. Pat. No. 5,876,359 to Bock et al.

Solenoid valves 58*a*, 58*b*, 58*c*, 60*a*, 60*b*, 60*c* are driven by pulse width modulated signals provided by the control processor of controller 14. The solenoid drive signals are initially at a higher power level for rapid and positive actuation of the solenoid valves. After initial actuation, the drive signals can be decreased, for example, by approximately 70% to maintain valve activation, thereby reducing power consumption. It is envisioned that solenoid valves 58*a*, 58*b*, 58*c*, 60*a*, 60*b*, 60*c* may be deactivated as desired. It is further envisioned that the control processor of controller 14 includes the ability to verify the status of solenoid valves 58*a*, 58*b*, 58*c*, 60*a*, 60*b*, 60*c*. As the condition of solenoid valves 58*a*, 58*b*, 58*c*, 60*a*, 60*b*, 60*c* changes, the control processor verifies their status. For example, if a particular valve is detected to be shorted or open, compression treatment system 10 will go into a particular error mode, as will be discussed.

Controller 14 also includes a pressure transducer 66 disposed within housing 12. Pressure transducer 66 is coupled to the pneumatic circuit and disposed between pump 50 and solenoid valves 58*a*, 58*b*, 58*c*, 60*a*, 60*b*, 60*c* via tubing or the like. Pressure transducer 66 is in fluid communication with inflatable chambers 46*a*, 46*b*, 46*c*, 48*a*, 48*b*, 48*c* for monitoring pressure in each of inflatable chambers 46*a*, 46*b*, 46*c*, 48*a*, 48*b*, 48*c*. The control processor of controller 14 directs pressure transducer 66 to measure any of inflatable chambers 46*a*, 46*b*, 46*c*, 48*a*, 48*b*, 48*c* that are connected to their respective solenoid valve and thus in fluid communication therewith. Disposing pressure transducer 66 before the solenoid valves, on the manifold side of the pneumatic circuit, advantageously facilitates use of only a single pressure transducer for measuring the pressure in the inflatable chambers. This configuration facilitates inflation of one or a plurality of inflatable chambers. This configuration also advantageously reduces bulk of controller 14 to contribute to the compact and lightweight design of compression treatment system 10, facilitates transport, patient mobility and reduces manufacturing costs.

For example, during a selected compression cycle, solenoid valves 58*a*, 58*b*, 58*c*, 60*a*, 60*b*, 60*c* are sequentially energized to the open position for pressurizing, in sequence, inflatable chambers 46*a*, 46*b*, 46*c*, 48*a*, 48*b*, 48*c*. In the open position, solenoid valves 58*a*, 58*b*, 58*c*, 60*a*, 60*b*, 60*c* allow passage of air from pump 50 through the respective output ports 38*a*, 38*b*, 38*c*, 40*a*, 40*b*, 40*c* to the inflatable chambers. Pressure transducer 66 monitors the pressure of each of inflatable chambers 46*a*, 46*b*, 46*c*, 48*a*, 48*b*, 48*c* of the pneumatic circuit and provides an electrical signal input to the control processor of controller 14 for feedback control.

At the end of the selected compression cycle, solenoid valves 58*a*, 58*b*, 58*c*, 60*a*, 60*b*, 60*c* are simultaneously de-energized to the closed position for disconnecting pump 50 from sleeves 46, 48. In the closed position, pump 50 air is blocked and solenoid valves 58*a*, 58*b*, 58*c*, 60*a*, 60*b*, 60*c* vent sleeve pressure to the atmosphere via vent ports 66*a*, 66*b*, 66*c*, 68*a*, 68*b*, 68*c* on valve manifold 52. It is contemplated that compression treatment system 10 can alternate inflation of the chambers between a first limb and a second limb. It is further contemplated that compression treatment system 10 can individually inflate each bladder.

Figure 6:
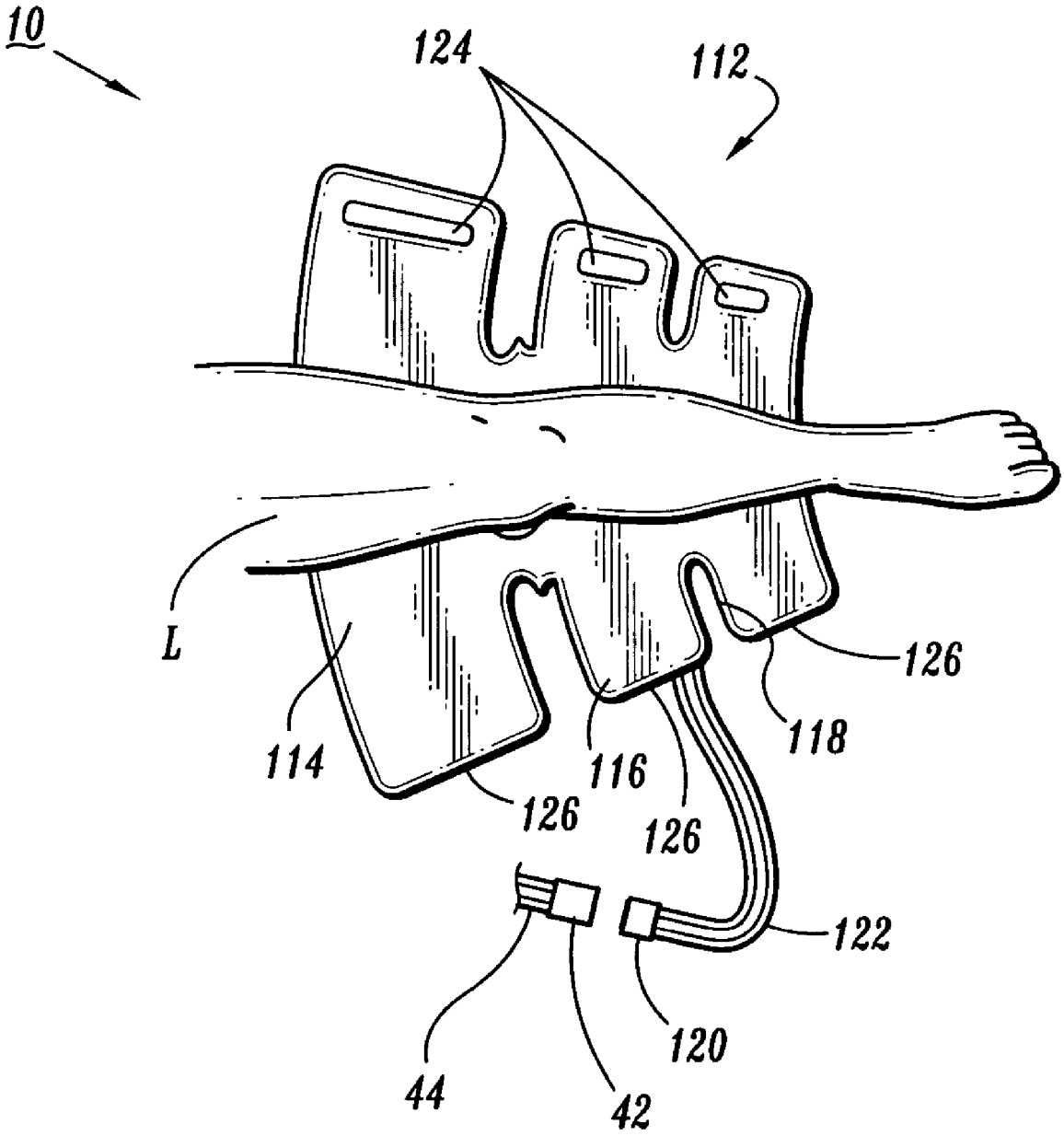
FIG. 6 is a plan view of a sleeve of the compression treatment system shown in FIG. 1 being disposed about a limb.

Referring to FIG. 6, compression treatment system 10, similar to that described above, is assembled and packaged for use. In operation, compression treatment system 10 includes controller 14 disposed with housing 12, described above, and a sleeve 112. Sleeve 112 includes a thigh bladder 114, a calf bladder 116 and an ankle bladder 118. Sleeve 112 includes a connector 120 that mates with mating connector 42, which is connected to port 38 via tubing 44. Connector 120 fluidly communicates with the chambers of sleeve 112 via tubing set 122. Thus, this configuration facilitates fluid communication between bladders 114, 116, 118 and pump 50. It is contemplated herein that connector 120 may further include a valve mechanism to control fluid flow.

Sleeve 112 is provided and manipulated for disposal about leg L of the subject (not shown). Connector 120 is mated with mating connector 42 to establish fluid communication between sleeve 112 and the pneumatic circuit. Sleeve 112 is wrapped about leg L and secured thereto via hook and loop pads 124, 126. It is contemplated that compression treatment system 10 may treat a second leg of a subject with a compression sleeve, similar to sleeve 112, via connection to port 40. The second leg is treated in compression cycles alternate to the compression cycles described below for treatment of leg L, as described below in the alternative.

The portable features of housing 12 and controller 14, described above, provide a compression treatment system 10 that facilitates transport and subject mobility. This advantageous configuration provides uninterrupted DVT prophylaxis as the system is used throughout a treatment facility, and can be worn and used continuously by the subject during the entire period of risk. Compression treatment system 10 advantageously facilitates continuous vascular therapy during subject activity and tasks such as, for example, transport for testing, bathroom, physical therapy, etc. Compression treatment system 10 prevents interruptions in therapy by providing controller 14 that will run on battery 28 when power cord 26 is not plugged in, and will also be comfortable, compact, and light enough to move with the subject as needed.

The manually activated switches of control panel 32 of controller 14 switch compression treatment system 10 on for powering thereof. As compression treatment system 10 is initially switched on, a series of self-tests are conducted by the control processor of controller 14. The LED indicators of display 36 are illuminated and audible indicia are sounded to verify the operability of the visual and audible indicators. Display 36 is illuminated to verify display operability. Controller 14 also verifies operability of the software of the control processor. If any of the verification fails, error codes provide a representative audible and/or visual indicia.

It is contemplated that if the control processor of controller 14 cannot continue normal software execution, an error code will be triggered. This causes compression treatment system 10 to reset and restart normal operation. Sleeve 112 would vent during a restart procedure. Audible and visual indicia may also engage to represent the condition.

Upon completion of the self-test sequence compression for treatment system 10, controller 14 begins a sleeve detection procedure to determine the type(s) of sleeves attached to ports 38, 40. Sleeve detection is performed during a first inflation (detection) cycle after controller 14 is initially powered on. During the detection cycle, air is delivered alternately through ports 38, 40 with pump 50 operating for two seconds, or until the pressure reaches a default threshold. One second later, pressure transducer 66 takes a pressure measurement to determine whether or not a bladder is connected to a particular output port, 38*a*, 38*b*, 38*c*, 40*a*, 40*b* or 40*c* under sleeve detection.

For example, the detection procedure is conducted for bladders 114, 116, 118 for each of sleeve ports 38,40. If there is no backpressure at a particular outlet port for connection with a bladder, then the control processor of controller 14 determines that a bladder is not being used with a particular outlet port. The control processor adjusts the compression therapy for the detected sleeve configuration accordingly. For the 3-bladder sleeve, back pressure is detected at bladders 114, 116, 118 when connected to controller 14. It is contemplated that if no sleeves are detected by this procedure at either port 38 or 40, or if the detected configuration is not recognized, then a low pressure error is triggered with corresponding audible indicia. It is further contemplated that various timing periods may be employed for detection inflation and pressure measurement, according to the requirements of a particular application.

Alternatively, thigh bladder 114 is removable from calf bladder 116. For example, calf bladder 116 is removably connected to thigh bladder 114 via a perforated attachment, see, for example, the sleeve described in U.S. patent application Ser. No. 10/784,607, filed on Feb. 23, 2004 and entitled Compression Apparatus, the entire contents of which is hereby incorporated by reference herein. For the removable thigh bladder 114, the control processor of controller 14 performs a similar sleeve detection procedure, as described above. The control processor will detect a 3-bladder sleeve due to a flow-restricting valve (not shown) fitted with connector 120. See, for example, the flow-restricting valve described in U.S. patent application Ser. No. 10/784,693, filed on Feb. 23, 2004 and entitled Fluid Conduit Connector Apparatus, the entire contents of which is hereby incorporated by reference herein. The flow restricting valve simulates the backpressure created by thigh bladder 114 when there is actually no bladder connected. Thus, the conversion from a 3-bladder thigh length sleeve to a 2-bladder knee length sleeve does not significantly impact the compression parameters, and controller 14 continues vascular therapy as if thigh bladder 114 was still intact.

Figure 7:
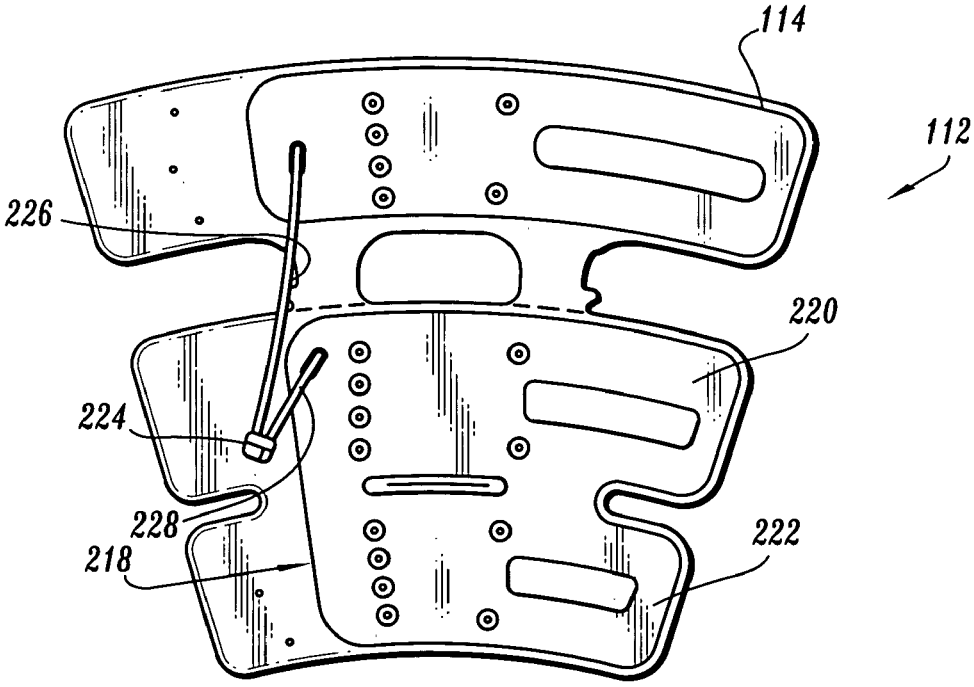
FIG. 7 is an alternate embodiment of the sleeve shown in FIG. 6.

In an alternate embodiment, as shown in FIG. 7, sleeve 112 includes thigh bladder 114 and a unitary second bladder 218. Second bladder 218 has a calf portion 220 and an ankle portion 222. Pump 50 fluidly communicates with sleeve 112 via valve connector 224 and separate tubing 226, 228, for employment similar to that described above, including the optional removal of thigh bladder 114 via perforations or the like.

In one particular compression cycle for compression treatment system 10, the compression parameters include an 11-second inflation period for inflating bladders 114, 116, 118 followed by 60 seconds of venting for deflating bladders 114, 116, 118. The 11-second inflation period is sequential:

1) initially ankle bladder 118 is inflated for a first time period starting at 0 seconds;
2) thereafter and during the first time period, inflation of calf bladder 116 is initiated for a second time period, the initiation of the second time period coinciding with approximately 2.67 seconds duration of the first time period;
3) thereafter and during the second time period, inflation of thigh bladder 114 is initiated for a third time period, the initiation of the third time period at approximately 3.0 seconds duration of the second time period and approximately 5.67 seconds of the first time period; and
4) after 11 seconds of the first time period, bladders 114, 116, 118 vent for a minimum of 20 seconds and a maximum of 60 seconds. An example is illustrated in Table 1 below.

TABLE 1

| | Start of Sequence | End of Sequence |
|---|---|---|
| Ankle Compression: | 0 seconds | 2⅔ seconds |
| Ankle/Calf Compression: | End of Ankle | 5⅔ seconds |
| Ankle/Calf/Thigh Compression: | End of Ankle/Calf | 11.0 seconds |
| Decompression/Vent: | Minimum 20 seconds, maximum 60 seconds | |

It is contemplated that the vent period is measured from the end of one inflation cycle to the beginning of the next inflation cycle on leg L. It is further contemplated that both limbs of the subject may be treated and compression treatment system 10 alternates vascular therapy from leg L to the second leg. It is envisioned that the time period from the end of the inflation cycle for leg L to the initiation of the inflation cycle for the second leg can range, for example, from 4.5-24.5 seconds.

During the initial inflation cycle for treating leg L, as described above, pump 50 initiates a low default voltage so as to not over-inflate bladders 114, 116, 118 on the initial cycle. Solenoid valves 58*a*, 58*b*, 58*c* are energized to the open position, as described, such that the valves open to deliver air to ankle bladders 118, then calf bladder 116, then thigh bladder 114 of sleeve 112 using a desired cycle timing sequence. Pressure transducer 66 monitors the pressure in each of bladders 114, 116, 118 throughout the 11-second compression cycle. At the conclusion of the inflation cycle, pump 50 stops and solenoid valves 58*a*, 58*b*, 58*c* de-energize to the closed position to allow bladders 114, 116, 118 to deflate through vent ports 66*a*, 66*b*, 66*c*.

It is envisioned that if a second leg of the subject is treated for vascular therapy, solenoid valves 60*a*, 60*b*, 60*c* are energized to the open position, as described, such that the valves open to deliver air to corresponding bladders of a sleeve disposed about the second leg, similar to sleeve 112, using a desired cycle timing sequence. Pressure transducer 66 monitors the pressure in each of the corresponding bladders throughout the 11-second compression cycle. At the conclusion of the inflation cycle, pump 50 stops and solenoid valves 60*a*, 60*b*, 60*c* de-energize to the closed position to allow the corresponding bladders to deflate through vent ports 68*a*, 68*b*, 68*c*. It is further envisioned that the inflation cycle for treatment of the second leg may be initiated approximately 24.5 seconds after completion of the inflation cycle for treating leg L. This process may be reiterated for cycles pertaining to both legs. Other cycle times are contemplated.

In this embodiment, the pressures, as measured by pressure transducer 66 and the corresponding signal relayed to the control processor of controller 14, of bladders 114, 116, 118 during the inflation cycle remain gradient with the pressure of ankle bladder 118 being greater than the pressure of calf bladder 116, and the pressure of calf bladder 116 being greater than the pressure of thigh bladder 114. The end of cycle pressures, for example, include 45 mm Hg in ankle bladder 118, 40 mm Hg in calf bladder 116, and 30 mm Hg in thigh bladder 114. An example is illustrated in Table 2 below. It is contemplated that compression continues in this cyclical pattern until either compression treatment system 10 is turned off or controller 14 indicates and error code via audible or visual indicia. Other cycles pressures are contemplated.

TABLE 2

| | Thigh-Length Sleeve | Knee-Length Sleeve | Pressure (mmHg) |
|---|---|---|---|
| Ankle bladder 118 | Ankle | Ankle | 45 mmHg |
| Calf bladder 116 | Calf | Lower Calf | 40 mmHg |
| Thigh bladder 114 | Thigh | Upper Calf | 30 mmHg |

For inflation cycles subsequent to the initial inflation cycle for leg L, as described, a pressure feedback adjustment can be made pursuant to the pressure measurement taken by pressure transducer 66. At the completion of the initial inflation cycle for leg L, the end of cycle pressure in ankle bladder 118 is measured by pressure transducer 66 and compared by the control processor of controller 14 with the set pressure of 45 mm Hg. If the pressure of ankle bladder 118 is higher or lower than the set pressure, then a corresponding decrease or increase in the speed of pump 50 is required to decrease or increase pressure delivery. The pump speed adjustment is based on the following calculation:

$$\text{Adjustment}=|45-P|, \text{ where P=pressure at the ankle}$$

If the pressure is less than the set pressure, then the pump speed for the next cycle is increased by the adjustment amount. If the pressure is greater than the set pressure, then the pump speed for the next cycle is decreased by the adjustment amount. It is contemplated that the adjustment process continues even after the set pressure range is reached. It is further contemplated compression treatment system 10 may adjust for separate pump speeds for each sleeve connected to controller 14. Other sequential compression cycles are also contemplated.

In an alternate embodiment, compression treatment system 10 performs venous refill time measurement. Venous refill time (VRT) measurement is an air plethysmographic technique that determines when the veins of a limb have completely refilled with blood following a compression cycle. See, for example, the venous refill time measurement described in U.S. Pat. No. 6,231,352 to Watson et al., the entire contents of which is hereby incorporated by reference herein. The VRT minimizes the amount of time that the blood remains stagnant inside the veins. The VRT will be substituted for the default rest time (60 seconds) as long as the VRT is between 20 and 60 seconds. If the VRT is less than 20 seconds then the default of 20 seconds is used. If the VRT is greater than 60 seconds then the maximum of 60 seconds is used. The VRT measurement is made when the system first reaches set pressure and once every 30 minutes thereafter. It is contemplated that the VRT technique and algorithm can be used for both sleeve and foot compression.

The VRT measurement uses an air plethysmographic technique where a low pressure is applied to the calf bladders. As the veins fill with blood, the pressures in the calf bladders increase until a plateau is reached. The time that it takes for the pressure to plateau is the VRT. If two sleeves are connected to controller 14, then the VRT is determined separately for each limb being compressed and the greater of the two measurements is used as the new vent time of the compression cycle. The VRT measurement for each sleeve is made as each particular sleeve reaches set pressure independently. However, the vent time is not updated until VRT measurements have been calculated for both sleeves.

For example, compression treatment system 10 may employ the VRT measurement after the system initiates vascular therapy. Subsequently, after 30 minutes have elapsed, a VRT measurement will be taken on the next full inflation cycle. After any of the sleeves described above inflates, the bladder(s) of the particular sleeve are vented down to zero as in the default inflation cycle.

It is contemplated that a selected bladder pressure is monitored and the vent to the bladder is closed when the pressure falls to 5-7 mm Hg. If the pressure in the bladder is 5-7 mm Hg on a current cycle then a VRT measurement is taken. If the pressure in the bladder does not vent down to 5-7 mm Hg then the vent time will remain at its current value and another measurement will be made in 30 minutes. If an error occurs, a corresponding alarm provides audible and/or visual indicia.

The VRT measurement algorithm determines when the pressures in the selected bladders plateau after compression. The VRT will be determined separately for both legs. The longer of the two refill times will be used as the new vent time. If compression is applied to only one leg, the VRT for that leg is used as the new vent time. The VRT measurement algorithm initiates with a time counter started from the end of the inflation cycle, which occurs after the selected bladder reaches 5-7 mm Hg (enough pressure to cause the bladder to remain in contact with the surface of the leg) and the venting is stopped. The VRT measurement initiates with the time counter started from the end of the inflation cycle.

The pressure in the selected bladder is then monitored. By way of example, the pressure is monitored with a 10-second, moving sample window. The window moves in 1-second intervals. When the difference between the first and last values in the window is less than approximately 0.3 mm Hg the curve has reached its plateau. The VRT measurement is considered done, and the time interval is determined. The end of the window is considered to be the point at which the venous system in the limbs has refilled.

Independent of the VRT measurement, the selected bladder is allowed to vent for at least 15 seconds before the next compression cycle on that same limb is started. As a safety factor, 5 seconds are added to the measured refill time so the limb is not compressed too early. It is contemplated that the vent time may be equivalent to the measured refill time plus 5 seconds. For example, as a result of patient movement, the standard deviation in the sample window may be too high making the measurement erroneous. At this point, the calculation is discarded and the old value of the VRT is used. The VRT measurement is considered erroneous if at any time during the measurement, the pressure in the selected bladder is below 2 mmHg, the calculation is discarded, and the old value of VRT is used. This may occur if there is a leak in the system. It is contemplated that if the pressure is greater than 20 mmHg at any time during the VRT measurement the old value of the VRT is used. It is further contemplated that if the VRT calculation is done for both legs, the longer VRT of both legs is used. It is envisioned that if the VRT is calculated to be greater than 60 seconds, a value of 60 seconds is used. If the VRT is calculated to be less than 20 seconds, a value of 20 seconds is used.

Alternatively, compression treatment system 10 may employ one, a plurality or all of the following error codes to provide audible and/or visual indicia of system error or failure. These features advantageously enhance safety to the subject during vascular therapy. Several error conditions may cause compression treatment system 10 to provide alarm and stop a particular compression cycle. It is contemplated that compression treatment system 10 may flash error indicators, sound continuous signals, etc., causing a user to reset compression treatment system 10. Controller 14 may provide an error alarm for one, a plurality or all of the following error conditions: high pressure error, including those pressures detected in excess of set pressure; low pressure error, including those pressures detected below set pressure and if no sleeves are detected; system pressure error, including pressure determined within an inflation cycle outside of desired parameters; valve error; software error; pump error; vent and deflation error; battery error; and temperature error, including temperatures detected outside of specified environmental conditions.

Figure 8:
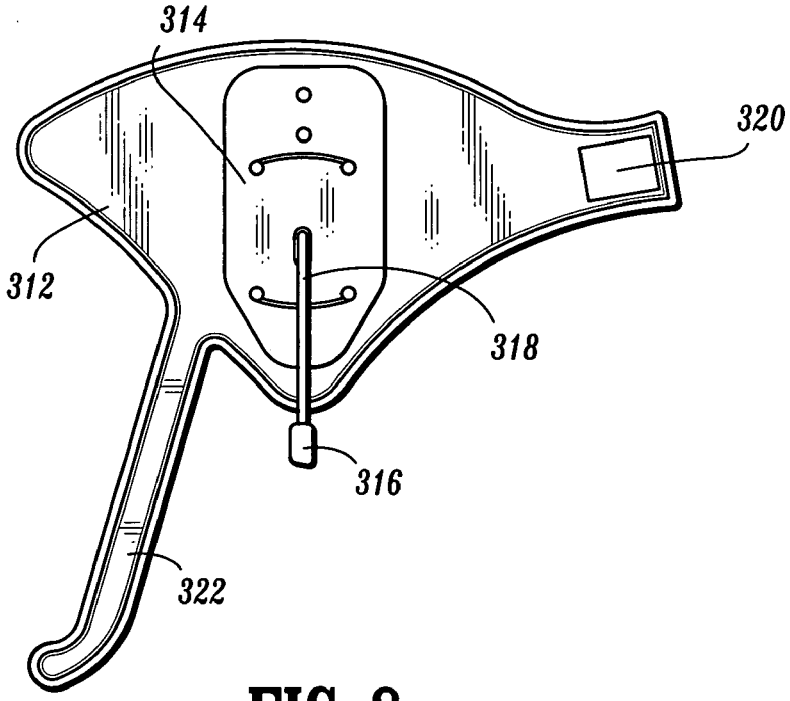
FIG. 8 is another alternate embodiment of the sleeve shown in FIG. 6.

In an alternate embodiment, as shown in FIG. 8, compression treatment system 10, similar to that described above, includes a foot sleeve 312 configured to provide vascular therapy to the foot of the subject. Foot sleeve 312 includes a bladder 314 that is inflated with air to provide application of pressure to the foot and then deflated. See, for example, the sleeve described in U.S. patent application Ser. No. 10/784,607, filed on Feb. 23, 2004 and entitled Compression Apparatus, the entire contents of which is hereby incorporated by reference herein.

Pump 50 fluidly communicates with foot sleeve 312. Sleeve 312 includes a connector 316 that mates with mating connector 42, which is connected to port 40 via tubing 44. Valve connector 316 fluidly communicates with bladder 314 of sleeve 312 via tubing 318. Thus, this configuration facilitates fluid communication between bladder 314 and pump 50. Foot sleeve 312 wraps about the side portions of the foot via a hook and loop type connector flap 320 that transverses the instep of the foot and a hook and loop type connector ankle strap 322.

Upon completion of the self-test sequence compression for treatment system 10, similar to that described, controller 14 begins the sleeve detection procedure to determine the type(s) of sleeves attached to ports 38, 40. With regard to foot sleeve 312, back pressure is detected by the control processor of controller 14 corresponding to bladder 314, which is connected to outlet port 40*b*. It is contemplated that compression treatment system 10 may treat the foot of a second leg of a subject with foot sleeve 312 and also treat leg L, as described above, in alternate inflation cycles.

In one particular exemplary compression cycle for foot sleeve 312, the compression parameters include a 5-second inflation period followed by 60 seconds of venting. An example is illustrated in Table 3 below.

TABLE 3

| | Start of Sequence | End of Sequence |
|---|---|---|
| Foot Compression: | 0 Seconds | 5.0 seconds |
| Decompression/Vent: | Minimum 20 seconds, maximum 60 seconds | |

It is contemplated that the vent period is measured from the end of one inflation cycle to the beginning of the next inflation cycle on the foot of the subject. It is further contemplated that both limbs of the subject may be treated and compression treatment system 10 alternates vascular therapy from leg L to the second leg. It is envisioned that the time period from the end of the inflation cycle for leg L to the initiation of the inflation cycle for the second leg can range from 7.5-27.5 seconds.

During the initial inflation cycle for treating the foot of the subject, as described above, pump 50 initiates a low default voltage so as to not over-inflate bladder 314 on the initial cycle. Solenoid valve 60*b* is energized to the open position, as described, such that the valve opens to deliver air to bladder 314 using a desired cycle timing sequence. Pressure transducer 66 monitors the pressure in bladder 314 throughout the 5-second compression cycle. At the conclusion of the inflation cycle, pump 50 stops and solenoid valve 60*b* de-energizes to the closed position to allow bladder 314 to deflate through vent port 68*b*.

It is envisioned that if a second foot of the subject is treated for vascular therapy, solenoid valve 58*b* is energized to the open position, as described, such that the valve opens to deliver air to a corresponding bladder of a foot sleeve disposed about the other leg, similar to foot sleeve 312, using a desired cycle timing sequence. For example, pressure transducer 66 monitors the pressure in the corresponding bladder throughout the 5-second compression cycle. At the conclusion of the inflation cycle, pump 50 stops and solenoid valve 58*b* de-energizes to the closed position to allow the corresponding bladder to deflate through vent port 66*b*. It is further envisioned that the inflation cycle for treatment of the second foot may be initiated approximately 27.5 seconds after completion of the inflation cycle for treating the foot treated by foot sleeve 312. This process may be reiterated for cycles pertaining to both feet, or in the alternative, for foot sleeve of a first leg and a leg sleeve of a second leg. It is contemplated that compression treatment system 10 may provide alternating compression to any combination of a sleeve and a foot garment and that if such a combination is employed, then, for example, a 6-second buffer of additional vent timing is added to all vent periods after the foot inflation cycle so that the overall timing is consistent with the default sleeve compression parameters. Other cycle times are contemplated.

In this embodiment, the target pressure, as measured by pressure transducer 66 and the corresponding signal relayed to the control processor of controller 14, of bladder 314 is, for example, 130 mm Hg. It is contemplated that compression continues in this cyclical pattern until either compression treatment system 10 is turned off or controller 14 indicates an error code via audible or visual indicia.

For inflation cycles subsequent to the initial inflation cycle for foot sleeve 312 described, a pressure feedback adjustment can be made pursuant to the pressure measurement taken by pressure transducer 66. At the completion of the initial inflation cycle for foot sleeve 312, the end of cycle pressure in bladder 314 is measured by pressure transducer 66 and compared by the control processor of controller 14 with the set pressure of 130 mm Hg. If the pressure of bladder 314 is higher or lower than the set pressure, then a corresponding decrease or increase in the speed of pump 50 is required to decrease or increase pressure delivery. The pump speed adjustment is based on the following calculation:

$$\text{Adjustment}=|130-P|, \text{ where } P=\text{pressure at the foot}$$

If the pressure is less than the set pressure, then the pump speed for the next cycle is increased by the adjustment amount. If the pressure is greater than the set pressure, then the pump speed for the next cycle is decreased by the adjustment amount. It is contemplated that the adjustment process continues even after the set pressure range is reached. It is further contemplated that compression treatment system 10 may adjust for separate pump speeds for each sleeve connected to controller 14. Other sequential compression cycles are also contemplated.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A compression treatment system comprising:

a first bladder supported about a limb;

a second bladder supported about the limb, the bladders being in fluid communication with a fluid source and the bladders being inflated such that the first bladder is inflated for a first time period and the second bladder is inflated for a second time period, the second time period and additional time periods being initiated within the first time period; and a pneumatic control circuit located at a controller housed separately from the inflatable bladders, the pneumatic control circuit including the controller, a single pressure sensor, a single check valve, the fluid source and a plural of solenoid valves, the single pressure sensor located between the fluid source and solenoid valves and communicating with the first bladder and the second bladder, and the single check valve operably connected to the fluid source and located between the fluid source and solenoid valves, wherein the single check valve prevents leakage out of the first bladder, and the single pressure sensor measures bladder pressure in cooperation with the controller to calculate venous refill time at the first bladder.

2. A compression treatment system as recited in claim 1, further comprising the controller that communicates with the pressurized fluid source and the pressure sensor, the controller being configured to monitor and regulate pressure in the bladders.

3. A compression treatment system as recited in claim 2, wherein the controller includes separate valves that regulate inflation of the bladders.

4. A compression treatment system as recited in claim 1, wherein the controller is disposed with the housing that is portable.

5. A compression treatment system as recited in claim 1, wherein the housing includes a plurality of ports connectable to a plurality of bladders.

6. A compression treatment system as recited in claim 5, wherein the single pressure sensor monitors pressure at each of the plurality of ports to determine if a bladder is connected thereto and sends a representative signal to the controller.

7. A compression treatment system as recited in claim 1, wherein the pressure sensor is configured to monitor pressure of each of the bladders.

8. A compression treatment system as recited in claim 1, further comprising a foot bladder communicating with the pressure sensor.

9. A compression treatment system as recited in claim 1, wherein the pressurized fluid source alternately inflates the bladders disposed about the first limb and the bladders disposed about the second limb.

10. A compression treatment system as recited in claim 1, wherein the check valve operates without an electrical signal to the controller.

11. A compression treatment system comprising:

a first bladder supported about a limb;

a second bladder supported about the limb, the first and second bladders being in fluid communication with a fluid source and the first and second bladders being inflated such that the first bladder is inflated for a first time period and the second bladder is inflated for a second time period, the second time period being initiated within the first time period;

a third bladder supported about a foot, the third bladder being in fluid communication with the fluid source; and a pneumatic control circuit located at a controller housed separately from the inflatable bladders, the pneumatic control circuit including the controller, a single pressure sensor, a single check valve, the fluid source and a plurality of solenoid valves, the single pressure sensor, located between the fluid source and solenoid valves, communicating with the bladders and the check valve operably connected to the fluid source and located between the fluid source and solenoid valves, wherein the single check valve prevents leakage out of a measuring bladder, the single pressure sensor measures bladder pressure in cooperation with the controller to calculate venous refill time at the measured bladder.

12. A compression treatment system as recited in claim 11, wherein the pressurized fluid source alternately inflates the bladders disposed about the limb and the bladder disposed about the foot.

13. A compression treatment system as recited in claim 12, wherein the controller is disposed with a housing that is portable.

14. A compression treatment system as recited in claim 12, wherein the controller includes separate valves that regulate inflation of the bladders.

15. A compression treatment system as recited in claim 11, further comprising a controller that communicates with the pressurized fluid source and the single pressure sensor, the controller being configured to monitor and regulate pressure in the bladders.

16. A compression treatment system as recited in claim 11, wherein the single pressure sensor is configured to monitor pressure of each of the bladders.

17. A compression treatment system as recited in claim 11, wherein the check valve operates without an electrical signal to the controller.

18. A compression treatment system comprising:

a first plurality of bladders supported about a first limb;

a second plurality of bladders supported about a second limb, the bladders being in fluid communication with a fluid source and the bladders being inflated such that:

a first bladder of the first plurality of bladders is inflated for a first time period and a second bladder of the first plurality of bladders is inflated for a second time period, the second time period being initiated within the first time period, and a first bladder of the second plurality of bladders is inflated for a third time period and a second bladder of the second plurality of bladders is inflated for a fourth time period, the fourth time period being initiated within the third time period; and a pneumatic control circuit located at a controller housed separately from the inflatable bladders, the pneumatic control circuit including the controller, a single pressure sensor, a single check valve, the fluid source and a plurality of solenoid valves, the single pressure sensor, located between the fluid source and solenoid valves, communicating with the bladders and the check valve operably connected to the fluid source and located between the fluid source and solenoid valves, wherein the single check valve prevents leakage out of a measuring bladder, the single pressure sensor measures bladder pressure in cooperation with the controller to calculate venous refill time at the measured bladder.

19. A compression treatment system as recited in claim 18, further comprising a controller that is disposed with a housing that is portable, the controller communicating with the pressurized fluid source and the single pressure sensor, the controller being configured to monitor and regulate pressure in the bladders.

20. A compression treatment system as recited in claim 18, wherein the check valve operates without an electrical signal to the controller.

21. A compression treatment system as recited in claim 18, wherein the measured bladder is selected from a group comprising the first bladder, second bladder, third bladder, and fourth bladder.

22. A compression treatment system comprising:

a first plurality of bladders being supported about a first limb and a second plurality of bladders being supported about a second limb;

each bladder of the first plurality of bladders and the second plurality of bladders having a separate valve in communication therewith, the valves being in fluid communication with a fluid source and the bladders being inflated such that:

a first valve is open such that a first bladder of the first plurality of bladders is inflated for a first time period and a second valve is open such that a second bladder of the first plurality of bladders is inflated for a second time period, the second time period being initiated within the first time period, and a third valve is open such that a third bladder of the first plurality is inflated for a third time period, the third time period being initiated within the second time period, and a fourth valve is open such that a first bladder of the second plurality of bladders is inflated for a fourth time period and a fifth valve is open such that a second bladder of the second plurality of bladders is inflated for a fifth time period, the fifth time period being initiated within the fourth time period, and a sixth valve is open such that a sixth bladder of the second plurality is inflated for a sixth time period, the sixth time period being initiated within the fifth time period;

a pneumatic control circuit located at a controller housed separately from the inflatable bladders, the pneumatic control circuit including the controller, a single pressure sensor, a single check valve, the fluid source and a plurality of solenoid valves, the controller communicates with the pressurized fluid source and the single pressure sensor, the controller being configured to monitor and regulate pressure in the bladders, the single pressure sensor, located between the fluid source and solenoid valves, communicating with the bladders and the check valve operably connected to the fluid source and located between the fluid source and solenoid valves, wherein the single check valve prevents leakage out of a measuring bladder, the single pressure sensor measures bladder pressure in cooperation with the controller to calculate venous refill time at the measured bladder.

23. A compression treatment system as recited in claim 22, wherein the check valve operates without an electrical signal to the controller.

* * * * *